US008621921B2

(12) United States Patent
Boe et al.

(10) Patent No.: US 8,621,921 B2
(45) Date of Patent: Jan. 7, 2014

(54) RETRIEVABLE DOWNHOLE TESTING TOOL

(75) Inventors: Asmund Boe, Paris (FR); Matthew Loth, Fontenay aux Roses (FR); Shaun Bambridge, London (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 516 days.

(21) Appl. No.: 12/745,588

(22) PCT Filed: Nov. 14, 2008

(86) PCT No.: PCT/EP2008/009657

§ 371 (c)(1),
(2), (4) Date: Sep. 8, 2010

(87) PCT Pub. No.: WO2009/068191

PCT Pub. Date: Jun. 4, 2009

(65) Prior Publication Data

US 2011/0011174 A1 Jan. 20, 2011

(30) Foreign Application Priority Data

Nov. 30, 2007 (EP) ..... 07291433

(51) Int. Cl.
*E21B 47/10* (2012.01)

(52) U.S. Cl.
USPC ..... 73/152.18

(58) Field of Classification Search
USPC ..... 73/152.18, 152.51, 152.29
See application file for complete search history.

(56) References Cited

U.S. PATENT DOCUMENTS

| | | | | |
|---|---|---|---|---|
| 2,582,718 | A | 1/1952 | Ragland | 166/152 |
| 5,887,657 | A * | 3/1999 | Bussear et al. | 166/336 |
| 5,934,371 | A | 8/1999 | Bussear et al. | 166/53 |
| 2001/0050170 | A1 | 12/2001 | Woie et al. | 166/252.1 |
| 2002/0070026 | A1 | 6/2002 | Fenton et al. | 166/368 |

* cited by examiner

*Primary Examiner* — Leonard Chang
*Assistant Examiner* — Tamiko Bellamy
(74) *Attorney, Agent, or Firm* — Cameron R. Sneddon

(57) ABSTRACT

A retrievable downhole testing tool that is adapted to be temporarily installed in a well is disclosed. The retrievable downhole testing tool comprises a variable choke, a tool control unit adapted to control the variable choke, and at least two measuring sensors adapted to measure physical parameters including pressure. At least one measuring sensor is situated above the variable choke, and at least one measuring sensor is situated below the variable choke. The retrievable downhole testing tool is pre-programmed with a specified test sequence for controlling a downhole flow rate using the variable choke and for executing downhole measurements of physical parameters at specified flow periods. The specified test sequence is adapted according to a pre-defined stability criterion using the tool control unit.

15 Claims, 3 Drawing Sheets

RETRIEVABLE DOWNHOLE TESTING TOOL

CROSS-REFERENCE TO RELATED APPLICATIONS

The present application is based on and claims priority to EP Application No. 07291433.6, filed 30 Nov. 2007; and International Patent Application No. PCT/EP2008/009657, filed 14 Nov. 2008. The entire contents of each are herein incorporated by reference.

BACKGROUND

1. Field of the Invention

The invention generally relates to a retrievable downhole tool for well testing and a method for testing a well using such.

2. Background Art

Well testing is a common technique used to obtain parameters describing the reservoir and to determine the well productivity. Well testing may be performed at any stage of the lifecycle of a well.

For example, well testing may be performed after drilling the well and before the well is completed for production. Data obtained from downhole instrumentation and fluid samples from a hydrocarbon reservoir provide information such as behavior of the reservoir fluids, formation permeability, skin factors, well productivity, connected volume, pressure, and temperature.

Well testing is also performed to monitor the performance of a production well. The formation pressure is measured by way of repeated pressure drawdown and buildup tests. A mechanically conveyed downhole shut-in valve may be used to shut-in and reopen the well. At the same time, the formation pressure is measured by placing a measuring sensor (e.g., a pressure recording gauge) downhole below the shut-in valve and near the producing formation, i.e., near the reservoir. A pressure drawdown test is conducted by flowing the well, and the well is shut-in for a pressure buildup test.

Typically, there are three well testing methods used in a production or completed well:

(a) performing a flow rate-test at various rates, whereby the well is choked at the well head;

(b) shutting in the well at the well head to conduct a pressure build-up test; and (c) running and temporarily installing a downhole shut-in tool in the well and fixing the shut-in tool in a landing nipple in order to perform a pressure build-up test.

In either case, the technique of slickline conveyed well testing tools may be used. It consists in lowering a specialized testing tool into the well to a zone of interest (i.e., near the reservoir) using slickline (i.e., a mechanical wire) and reading sensor data from the tool on the fly or stored in the gauge memory. Formation testing tools for slickline testing may also be adapted to obtain fluid samples from the formation. Data collected downhole during well testing may be communicated electronically to the surface for logging. This permits data to be analyzed in real-time.

In all cases (a), (b), and (c), it is assumed to record the downhole pressure close to the sandface, i.e., close to the reservoir, by permanently installed or slickline conveyed pressure gauges. In the case of surface choking and shut-in [(a) and (b) above], large well bore storage or fluid compressibility effects may occur, which mask the reservoir response and increase time needed for stabilisation. Thus, the time required for the test is increased, and it may be impossible to obtain meaningful data about the reservoir. Other well bore dynamic effects as, for example, fluid segregation, may have an impact on both flow rate and flowing pressure stability. Liquid fall back and changing liquid levels may corrupt shut-in data. Furthermore, back allocation of surface flow rates is not always proportional for high gas-oil-ratio wells if the flow rate is controlled from the well head.

In the case of downhole shut-in [(c) above], there are numerous practical limitations, such as the availability of completion nipples to set and seal the tool, the condition of those nipples and thus the potential for leakage, problems with retrieval or re-start of the well, etc. Also, in comparison to drawdown testing in isolation, there is the cost of shut-in and deferred production.

Specifically, there are no cost effective, low risk, and simple methods available to date to assess inflow performance, to determine production potential, and/or to update the reservoir description of producing gas wells. The same applies, to a lesser extent, to oil wells. More importantly in the oil domain, given the large and increasing number of wells with reduced reservoir pressure, there is a risk of killing the well by shutting it in. Thus, a two-fold cost increase is generated due to deferred production and subsequent intervention to recommence production.

Therefore, due to the respective disadvantages of these methods, it is not always possible to obtain interpretable data, and the test objectives may not be met.

SUMMARY OF INVENTION

The invention aims to provide a retrievable downhole testing tool that overcomes the disadvantages listed above.

In a first aspect, the invention relates to a retrievable downhole testing tool that is adapted to be temporarily installed in a well. The retrievable downhole testing tool comprises a variable choke, a tool control unit adapted to control the variable choke, and at least two measuring sensors adapted to measure physical parameters comprising pressure, whereby one measuring sensor is situated above the variable choke, and at least one measuring sensor is situated below the variable choke. The retrievable downhole testing tool is pre-programmed with a specified test sequence for controlling the downhole flow rate using the variable choke and for executing downhole measurements of physical parameters at specified flow periods. The specified test sequence may be adapted according to a pre-defined stability criterion using the tool control unit.

In a second aspect, the invention relates to a well testing system. The well testing system comprises a retrievable downhole testing tool according to the first aspect of the invention and a communication unit to communicate signals between the retrievable downhole testing tool and a surface location.

In a third aspect, the invention relates to a method for testing a well using a retrievable downhole testing tool according to the first aspect of the invention. The method comprises pre-programming the retrievable downhole testing tool with a specified test sequence for controlling a downhole flow rate using the variable choke and for executing downhole measurements of physical parameters at specified flow periods, temporarily installing the retrievable downhole testing tool in the well, initiating the specified test sequence, and adapting the specified test sequence according to a pre-defined stability criterion using the tool control unit.

Other aspects and advantages of the invention will be apparent from the following detailed description and the appended claims.

DETAILED DESCRIPTION

Figure 1:
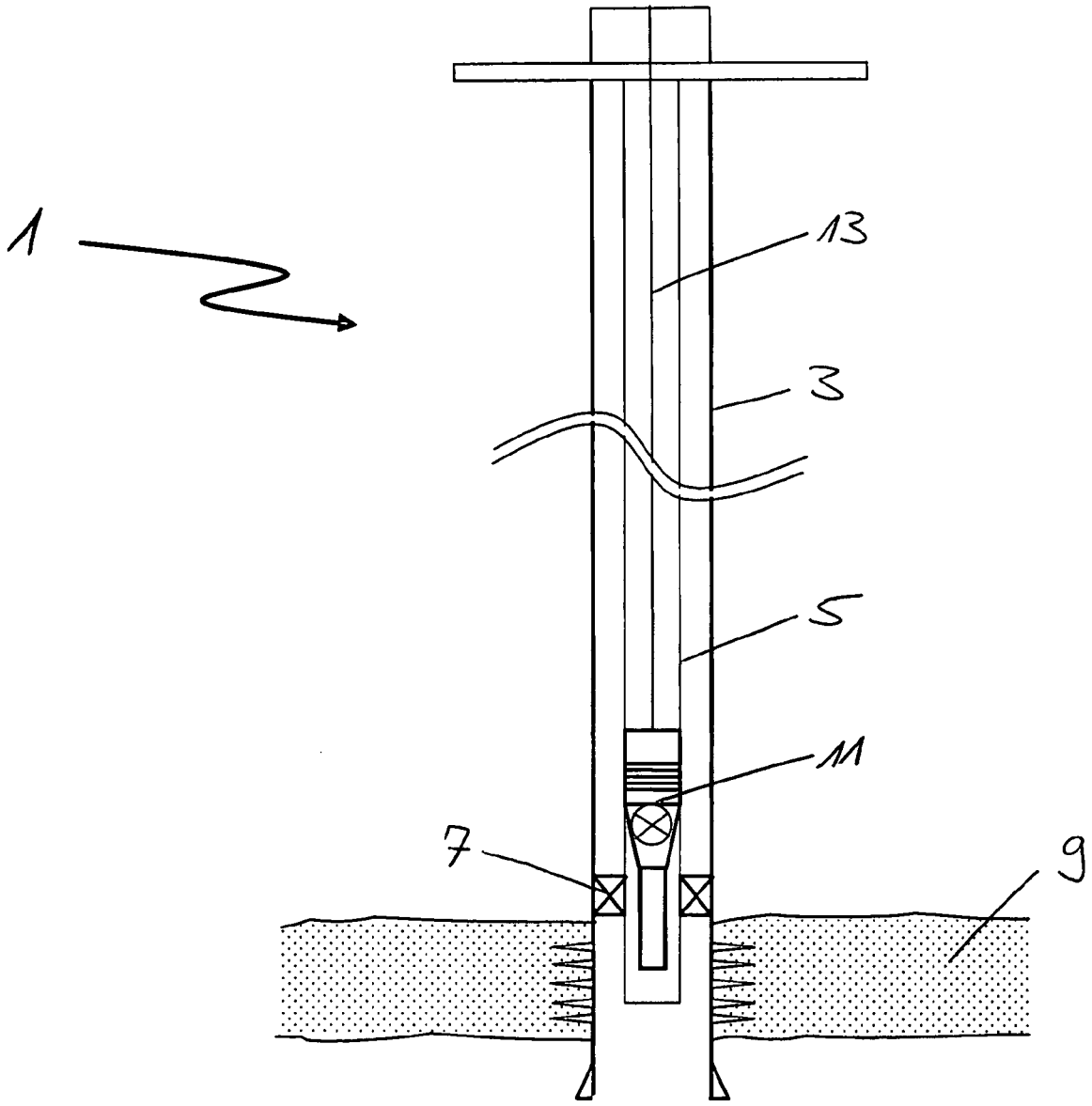
FIG. 1 shows a schematic view of a completed well with a retrievable downhole testing tool according to the invention installed therein.

Exemplary embodiments of the invention will now be described in detail with reference to the accompanying figures, in which like elements may be denoted by like reference numerals for consistency.

In a first aspect, embodiments disclosed herein relate to a retrievable downhole testing tool that is configured to be temporarily installed in a well (in a tubing string or in a monobore) near the reservoir or the formation, and that comprises a variable choke as well as inbuilt tool intelligence functions. FIG. 1 shows schematically a well 1 comprising a casing 3, a tubing string 5, an annulus (not shown) between the casing 3 and the tubing string 5, and a packer 7 to isolate the annulus from the reservoir 9. According to the embodiment of FIG. 1, a testing tool 11 is mechanically conveyed downhole 13 so as to be installed near the reservoir 9. The testing tool 11 may then be set or anchored within the tubing string 5 to create a seal between the tubing string 5 and the reservoir 9. Across this seal, a differential pressure can be maintained.

Figure 2:
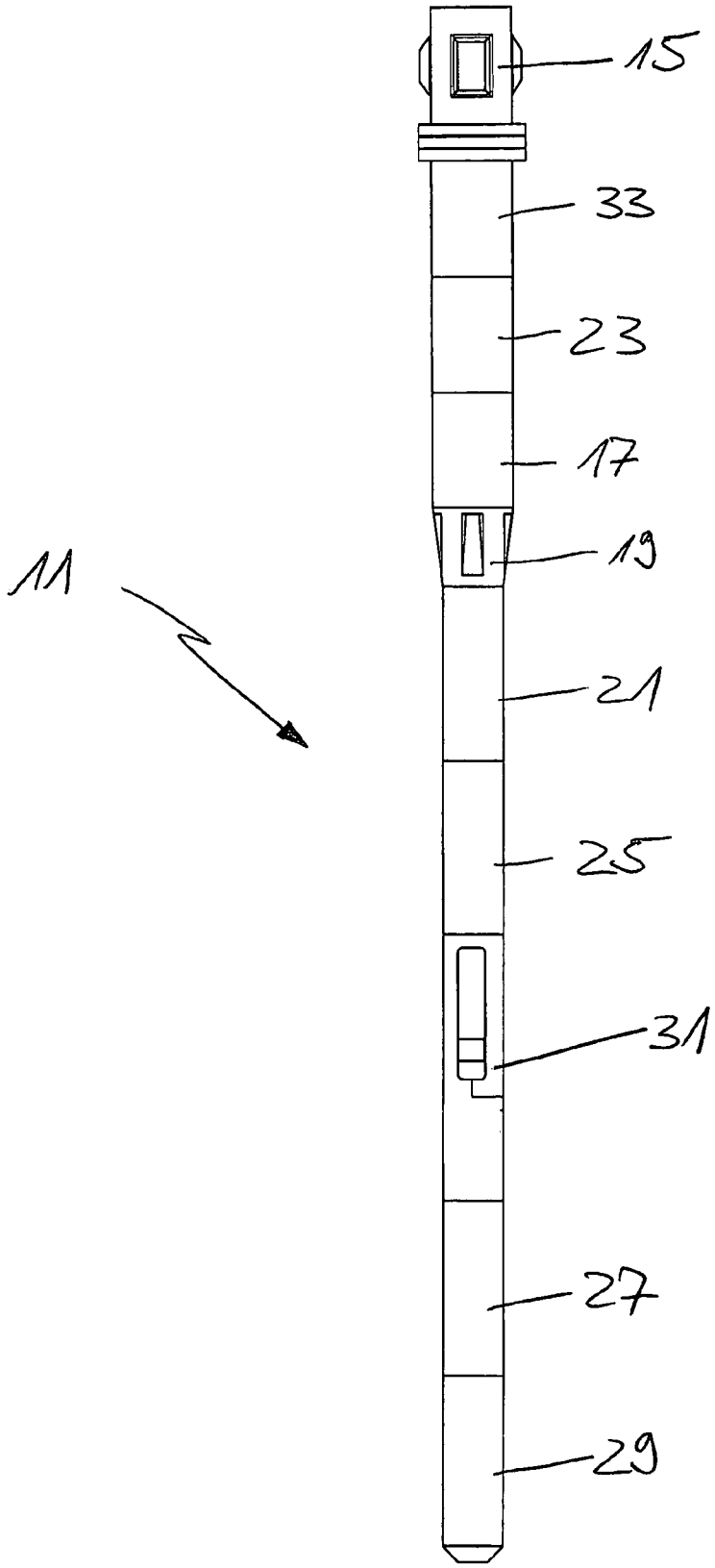
FIG. 2 shows a schematic view of the retrievable downhole testing tool according to an embodiment of the invention.

Referring now to FIG. 2, a retrievable downhole testing tool 11 according to an embodiment of the invention is schematically shown. The testing tool 11 comprises a fixing module 15 to set the testing tool in the tubing, a downhole choke 17, a flow intake port 19 or any other means known in the art to allow the fluid to flow into the choke 17, an actuator 21, an upper measuring sensor 23, and a lower measuring sensor 25. It further comprises a tool control unit 27, and a power supply unit 29. The downhole choke 17 according to the invention is adapted to vary a restriction in diameter of the flow area so as to control the flow rate of the fluid flowing through the choke. Preferentially, the flow area of the variable choke 17 is the only flow area of the testing tool 11 that is restrictable. This means that the flow is only limited by the flow area of the variable choke 17, i.e., all other flow areas within the testing tool 11 should not restrict the flow of fluid through the testing tool 11. Thus, all other flow areas within the testing tool must exceed the equivalent flow area of the maximum choke position.

The tool control unit 27 is configured to implement intelligent functions, e.g., execute a pre-programmed test sequence, process information from the measuring sensors, make simple decisions, control and limit drawdown and differential pressure to ensure critical flow across the variable choke, calculate and regulate the flow rate, etc. In particular, the tool control unit 27 according to the invention is configured to recognize when a pre-defined stability criterion has been met so that the pre-programmed test sequence can be adapted to real downhole conditions in order to optimize the test duration. For example, the stability criterion will be met when a variation of previously measured pressure values has converged to a defined value. The person skilled in the art will appreciate that the stability criterion may concern pressure, flow rate, temperature, or any other physical quantity that is used to characterize downhole conditions. Thus, the terms pressure stability criterion, flow rate stability criterion, etc., may be employed.

The fixing module 15 of the retrievable downhole testing tool 11 in accordance with embodiments disclosed herein may be a lock mandrel or any other mechanism known in the art to set or anchor the downhole testing tool 11 in the tubing or in the monobore. The fixing module may be adapted to different well completions and/or customer specifications. Other modules of the downhole testing tool 11 are adapted to be easily connectable to the fixing module 15.

In an embodiment of the invention, the fixing module 15 may be interchangeable. It may be run by coiled tubing or tractor in highly deviated wells.

In the retrievable downhole testing tool according to the embodiment of FIG. 2, the upper measuring sensor 23 is located downstream of the choke 17, and the lower measuring sensor 25 is located upstream of the choke 17. The upper and the lower measuring sensors 23, 25 advantageously comprise a pressure gauge. This configuration allows both measuring a bottom hole flowing pressure upstream of the choke 17 using the lower measuring sensor 25 and measuring a differential pressure across the choke using the upper and the lower measuring sensors 23, 25.

The person skilled in the art will appreciate that the measuring sensors may be located elsewhere, provided that the pressure measurement is performed upstream and downstream of the variable choke 17. For example, an upstream port and a downstream port may be disposed upstream and downstream of the variable choke 17 and be in communication with the lower and the upper measuring sensors 25, 23, respectively.

In another preferred embodiment, the retrievable downhole testing tool according to the invention comprises three pressure gauges: two gauges are located upstream of the downhole choke 17 and one gauge is located downstream of the downhole choke 17. This embodiment enables to reduce the physical noise caused by the wellbore dynamics and optimize the process for recognizing when the pressure stability criterion is met. Based on the tolerance accepted for the change in pressure with respect to time, the difference between the two values of the pressure measured by the two pressure gauges upstream of the choke will indicate whether a stabilized pressure has been achieved or not.

In another preferred embodiment of the invention, the tool control unit 27 of the retrievable downhole testing tool 11 is equipped with firmware and configured to record measured pressure and temperature values in a tool memory and to automatically execute a pre-programmed test sequence. The pre-programmed test sequence is implemented by controlling the actuator 21 of the downhole testing tool in order to actuate the variable choke 17.

In another preferred embodiment of the invention, the retrievable downhole testing tool 11 further comprises a power supply unit 29 to supply electrical power. The power supply unit 29 may supply electrical power to the tool control unit 27, a motor, a shut-in valve, the actuator 21, etc. Advantageously, the power supply unit 29 is designed to operate all the onboard electronics for a conservative duration of time, including choke changes and/or shut-in, equalization, open cycles, etc. The person skilled in the art will appreciate that the downhole testing tool 11 may comprise more than one power supply unit according to application-specific requirements.

In another embodiment of the invention, the testing tool according to the invention further comprises a shut-in valve configured to shut-in the well downhole. Thus, the testing tool comprises both the variable choke and the shut-in valve. Both flow rate control and pressure build-up tests, fully implemented downhole, may then be carried out with the same testing tool.

Advantageously, the shut-in valve is part of the downhole choke. Accordingly, the testing tool comprises a single variable choke and shut-in valve that is adapted to perform both flow rate control and shut-in functions. The shut-in valve enables the realization of pressure build-up tests and pressure equalization above and below the variable choke after pressure build-up tests and prior to retrieving the testing tool from the well.

The flow intake port 19 of the retrievable downhole testing tool 11 according to the embodiment of the FIG. 2 may be either an independent module or it may be integrated within the tool 11. In either case, the flow intake port 19 is functionally adapted to different completions and/or customer specifications, i.e., different sizes of the port 19 may be required to provide for different flow rates and tubing string sizes.

Still referring to FIG. 2, the downhole testing tool 11 further comprises an actuator 21 configured to control the variable choke and shut-in valve. The actuator 21 is, for example, situated below the flow intake ports 19.

In one embodiment of the invention, the actuator 21 is controlled electrically. In another embodiment, it is controlled hydraulically. In such a case, the retrievable downhole testing tool further comprises a hydraulic module comprising a pressurized power fluid.

In another embodiment of the invention, the retrievable downhole testing tool 11 further comprises a sampling module 31 with one or several sampling tools. Preferentially, the sampling module 31 is situated below the variable choke 17. The sampling tools are configured to capture single-phase gas or oil samples from downhole. Advantageously, the sampling tools are thereby triggered by the tool control unit 27 so that they operate at optimized downhole conditions, i.e., when the stability criterion has been met.

Figure 3:
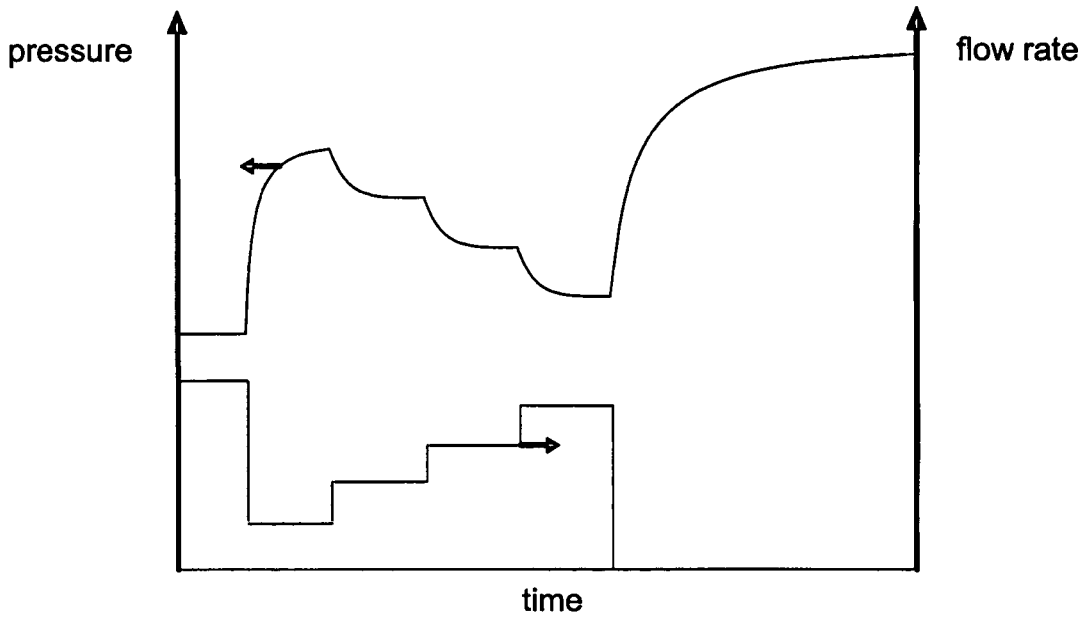
FIG. 3 shows an example diagram of measured downhole pressure and flow rate as a function of time using the retrievable downhole testing tool according to the invention.

In another embodiment of the invention, the retrievable downhole testing tool 11 further comprises a downhole flow metering device 33. The downhole flow metering device is, for example, a spinner, a venturi, or any other flow rate sensor known in the art. According to this embodiment, it is possible to measure the downhole pressure and the flow rate in the same location and simultaneously. One example of such a measurement is shown in FIG. 3. The diagram in FIG. 3 shows temporal evolutions of the downhole pressure and the flow rate. The steps in the flow rate and in pressure correspond to different flow periods, i.e. to different flow areas of the choke (or choke sizes). The last period where the flow rate is zero corresponds to a downhole shut-in. During each flow rate or shut-in period, the downhole pressure changes rapidly initially, until it reaches a stabilised (i.e., slowly varying) value. This corresponds to reaching the pressure stability criterion, as described above. Upon equalization, subsequent flow periods or retrieval of the downhole testing tool may be initialized.

In a second aspect, the invention provides a well testing system. The system comprises a retrievable downhole testing tool according to the first aspect of the invention, a communication unit, and means for running the downhole testing tool into the well and for retrieving the downhole testing tool from the well. The communication unit preferably comprises a wireless telemetry system using electro-magnetic, acoustic, or any other transmission technique known in the art. It may also comprise any other communication system used in a wellbore known in the art. The means for running and retrieving the downhole testing tool may be a slickline or any other means or conveyance known in the art (e.g., coiled tubing or tractor).

In a third aspect, the invention relates to a method of testing a well using a retrievable downhole testing tool according to the first aspect of the invention. According to a first embodiment, the tool control unit of the downhole testing tool is pre-programmed with a specified test sequence by an operator on the surface. The tests in the specified test sequence advantageously comprise pressure value measurements. The person skilled in the art will appreciate that other physical parameters of the reservoir may be measured by way of this method. The well is then choked back at the surface so that it is still flowing. It may also be shut-in at this stage. The downhole testing tool may be conveyed downhole by means of a slickline or any other means of conveyance known in the art (e.g. coiled tubing). Then, the downhole testing tool is temporarily installed downhole using the fixing module of the testing tool, and the means of conveyance is removed from the well.

Once the testing tool is installed, the specified test sequence can be initialized by the operator or automatically. The specified test sequence allows the variable choke to adjust a flow area in order to realize different flow rate periods. In other words, the fluid flows through the choke at different flow rates for given periods of time. The specified test sequence is configured in such a way to perform flow periods at various choke settings with the choke changes occurring only when a pre-defined stability criterion has been met.

In another embodiment, the specified test sequence allows to adjust the position of the shut-in valve.

If the stability criterion is not met, the tool control unit will control the testing tool in order to adapt the specified test sequence until the stability criterion is met.

In another embodiment of the invention, the method further comprises communicating physical data and/or commands between the downhole testing tool and an operator at the surface using the communication unit. Advantageously, measured physical data are transferred from downhole to the operator in real time. The operator may also be prompted by the tool control unit to transmit a command response to the downhole testing tool. For example, the operator will decide upon the received physical data if the specified test sequence needs to be changed. This enables to optimize the testing method with respect to test time and test accuracy.

This communication step enables a greater safety for the operation by allowing the operator to prepare for any changes in flow rate or pressure at the surface. It therefore provides for superior test quality by enabling informed decision making based on downhole conditions and test data received.

When the tests defined in the test sequence are completed, the downhole testing tool can be unset and retrieved from the well.

According to another embodiment, the method further comprises calculation of the flow rate by using measurements of pressure values upstream and downstream the choke, or by using a spinner, a venturi, or any other flow rate sensor known in the art. In this way, a flow period duration may be controlled, and the flow area of the downhole choke may be adjusted to obtain a desired flow rate.

According to another embodiment, the method further comprises taking downhole samples. In this embodiment, the tool control unit is used to trigger bottom hole sampling tools that are located below the variable choke or the shut-in valve so that samples are taken at specific flow periods. The person skilled in the art will appreciate that other functionalities may be implemented by using the tool control unit of the testing tool.

According to another embodiment, the method further comprises shutting-in the well using the shut-in valve of the downhole testing tool. For an improved control of pressure buildup measurements, two or more pressure gauges situated upstream and/or downstream of the shut-in valve may be used.

The tool control unit of the testing tool according to the invention may provide several advantages that result from the functionalities that the tool control unit provides to the testing tool. Several functionalities may be derived from the pressure measurements according to the test sequence. This is illustrated by the following examples. For example, pressure drawdown control may be enabled using the tool control unit. The maximum drawdown may be limited at any flow rate period in order to prevent, for example, flow below the saturation pressure (bubble point or dew point), prevent sanding, and/or water coning/gas cusping. By measuring the bottomhole flowing pressure upstream the downhole choke, the testing tool may be able to maintain pressure above a pre-set minimum. Thus, well testing may be carried out by drawdown, i.e., no shut-in is required.

A further example is the control of pressure fluctuations downstream the choke. As a matter of fact, for accuracy and simplification of well test interpretation it may be important to have a critical flow condition at the choke which prevents any pressure fluctuation creating back pressure downstream the choke to cross the choke and affect the bottomhole flowing pressure. By measurement of pressure values upstream and downstream the choke it is possible to ensure a critical flow across the choke by automatically adjusting the flow area of the choke until obtaining the critical flow condition. Thus, through the improvement of the stability of the flowing conditions (i.e., pressure and flow rate), a well test may be conducted in less time and with better quality of the obtained data.

Furthermore, using the downhole testing tool according to embodiments of the invention, flow-rate dependent wellbore parameters may be obtained. For example, the flow-rate dependent skin factor is a necessary parameter in evaluation of gas well productivity. In addition, it may be possible to clearly differentiate between what is happening inside the wellbore (i.e., in the upper part of the completion) and below the downhole tool (i.e., at the sandface). The pressure downstream the downhole choke of the downhole testing tool will not affect the pressure upstream the downhole choke under critical flow conditions. This may be efficient to avoid wellbore dynamic effects during a multi-rate well test.

As described above, by using the downhole choke according to the invention, pressure interference between the upper part of the completion and the bottomhole may be avoided. Therefore, a stabilized flow rate and pressure may be more easily achieved thus simplifying the interpretation of drawdown or build-up data.

While the invention is described in relation to preferred embodiments and examples, numerous changes and modifications may be made by those skilled in the art regarding parts of the downhole testing tool and steps of the testing method without departing from the scope of the invention.

The invention claimed is:

1. A method for testing a well using a retrievable downhole testing tool adapted to be temporarily installed in the well, the retrievable downhole testing tool comprising a variable choke, at least two measuring sensors, and a tool control unit adapted to control the variable choke and to process information from the measuring sensors, the at least two measuring sensors being adapted to measure physical parameters including pressure, whereby at least one measuring sensor is situated above the variable choke, and at least one measuring sensor is situated below the variable choke, the method comprising:

pre-programming the tool control unit with a specified test sequence for controlling a downhole flow rate using the variable choke and for executing downhole measurements of physical parameters at specified flow periods using the measuring sensors, and pre-programming the tool control unit to adapt the specific test sequence during the well testing according to a pre-defined stability criterion;

temporarily installing the retrievable downhole testing tool in the well;

initiating the specified test sequence; and adapting the specified test sequence during the well testing according to the pre-defined stability criterion using the tool control unit.

2. The method according to claim 1, further comprising shutting-in the well for conducting a pressure build-up test using the retrievable downhole testing tool.

3. The method according to claim 1, further comprising measuring the downhole flow rate using a flow metering device of the retrievable downhole testing tool.

4. The method according to claim 1, further comprising measuring the downhole flow rate using the measuring sensors of the retrievable downhole testing tool.

5. The method according to claim 1, further comprising taking downhole samples using a sampling module adapted to be controlled by the tool control unit.

6. A retrievable downhole testing tool adapted to be temporarily installed in a well, the retrievable downhole testing tool comprising:

a variable choke;

at least two measuring sensors adapted to measure physical parameters comprising pressure, whereby at least one measuring sensor is situated above the variable choke, and at least one measuring sensor is situated below the variable choke; and a tool control unit adapted to control the variable choke and to process information from the measuring sensors;

whereby the tool control unit is pre-programmed with a specified test sequence for controlling a downhole flow rate using the variable choke and for executing downhole measurements of physical parameters at specified flow periods using the measuring sensors, and is pre-programmed to adapt the specific test sequence during the well testing according to a pre-defined stability criterion, and whereby the specified test sequence is adapted during the well testing according to the pre-defined stability criterion using the tool control unit.

7. The retrievable downhole testing tool according to claim 6, further comprising a downhole shut-in valve adapted to shut-in and re-open the well downhole at a specified sequence controlled by the tool control unit.

8. The retrievable downhole testing tool according to claim 6, further comprising a sampling module adapted to be controlled by the tool control unit to take downhole samples.

9. The retrievable downhole testing tool according to claim 6, further comprising a flow metering device configured to measure the downhole flow rate.

10. A well testing system comprising:

a retrievable downhole testing tool according to claim 6 adapted to be temporarily installed in a well; and a communication unit to communicate signals between the retrievable downhole testing tool and a surface location.

11. The well testing system according to claim 10, further comprising means to convey into the well and retrieve from the well the retrievable downhole testing tool.

12. The system according to claim 10, wherein the means to convey and retrieve the retrievable downhole testing tool comprises a slickline.

13. The system according to claim 10, wherein the means to convey and retrieve the retrievable downhole testing tool comprises coiled tubing.

14. The system according to claim 10, wherein the communication unit comprises a wireless telemetry system.

15. The method of claim 1, further comprising:

carrying out the well testing by drawdown.

* * * * *